US011244623B2

(12) United States Patent
Chen

(10) Patent No.: US 11,244,623 B2
(45) Date of Patent: Feb. 8, 2022

(54) PIXEL CIRCUIT AND DRIVING METHOD THEREOF

(71) Applicant: AU Optronics Corporation, Hsin-Chu (TW)

(72) Inventor: Hung-Chi Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/997,047

(22) Filed: Aug. 19, 2020

(65) Prior Publication Data

US 2021/0118367 A1 Apr. 22, 2021

(30) Foreign Application Priority Data

Oct. 17, 2019 (TW) ..... 108137549

(51) Int. Cl.
*G09G 3/3258* (2016.01)
*G09G 3/3266* (2016.01)
*G09G 3/3233* (2016.01)

(52) U.S. Cl.
CPC ..... *G09G 3/3258* (2013.01); *G09G 3/3266* (2013.01); *G09G 3/3233* (2013.01); *G09G 2300/0819* (2013.01); *G09G 2300/0861* (2013.01); *G09G 2310/0251* (2013.01); *G09G 2310/08* (2013.01); *G09G 2320/0233* (2013.01); *G09G 2320/0247* (2013.01)

(58) Field of Classification Search
CPC .. G09G 3/3208; G09G 3/3225; G09G 3/3233; G09G 3/3258; G09G 3/3266; G09G 3/3648; G09G 2300/0819; G09G 2300/0861; G09G 2310/0251; G09G 2310/08; G09G 2320/021; G09G 2320/0233; G09G 2320/0247
See application file for complete search history.

(56) References Cited

U.S. PATENT DOCUMENTS

2005/0017934 A1* 1/2005 Chung ..... G09G 3/3233 345/82
2005/0093787 A1* 5/2005 Kim ..... G09G 3/3233 345/76

(Continued)

FOREIGN PATENT DOCUMENTS

CN 106531077 A 3/2017

*Primary Examiner* — Michael J Eurice
(74) *Attorney, Agent, or Firm* — WPAT, PC

(57) ABSTRACT

A pixel circuit includes: a first to a sixth transistors, a driving transistor and a capacitor. A first-terminal of the first transistor receives a reference voltage. A first-terminal of the second transistor and a first-terminal of the third transistor are coupled to a second-terminal of the first transistor. A second-terminal of the second transistor and a control-terminal of the driving transistor are coupled to a first node. A first-terminal of the fourth transistor receives a data signal. A first-terminal of the fifth transistor receives a system high voltage. A second-terminal of the fourth transistor, a second-terminal of the fifth transistor and a first-terminal of the driving transistor are coupled to a second node. The driving transistor is coupled to a light emitting element through the sixth transistor. The capacitor is coupled between the first node and a first-terminal of the fifth transistor.

5 Claims, 13 Drawing Sheets

(56) References Cited

U.S. PATENT DOCUMENTS

| | | | | |
|---|---|---|---|---|
| 2011/0057917 | A1* | 3/2011 | Ryu | G09G 3/3266 345/211 |
| 2011/0157125 | A1* | 6/2011 | Choi | G09G 3/3291 345/211 |
| 2015/0279274 | A1* | 10/2015 | Pyo | G09G 3/3233 345/77 |
| 2016/0063943 | A1* | 3/2016 | Lee | G09G 3/3233 345/211 |
| 2016/0063961 | A1* | 3/2016 | Pyo | G09G 3/3266 345/213 |
| 2016/0098955 | A1* | 4/2016 | Huang | G09G 3/3233 345/77 |
| 2016/0125808 | A1* | 5/2016 | Hsu | G09G 3/3233 345/212 |
| 2017/0124958 | A1* | 5/2017 | Pyo | G09G 3/3233 |
| 2017/0148379 | A1* | 5/2017 | Cho | G09G 3/3233 |
| 2017/0148383 | A1* | 5/2017 | Kim | G09G 3/3266 |
| 2018/0374419 | A1* | 12/2018 | Chen | G09G 3/3233 |
| 2020/0243014 | A1* | 7/2020 | Zhu | G09G 3/3266 |

* cited by examiner

100

100

PIXEL CIRCUIT AND DRIVING METHOD THEREOF

CROSS-REFERENCE TO RELATED APPLICATION

This application claims priority to Taiwan Application Serial Number 108137549, filed Oct. 17, 2019, which is herein incorporated by reference in its entirety.

BACKGROUND

Field of Invention

This disclosure relates to a pixel circuit and its driving method, and in particular to a pixel circuit and its driving method suitable for a low frame rate.

Description of Related Art

With the increasing demand for digital display devices, low frame rate is widely used in display devices to reduce power consumption, achieve power saving and prolong the lifetime.

However, when the picture is not updated, the number of frame maintaining the previous picture during the light-emitting phase will cause unstable display brightness, which will cause flicker.

SUMMARY

An aspect of this disclosure relates to a pixel circuit. The pixel circuit includes a first transistor, a second transistor, a third transistor, a fourth transistor, a fifth transistor, a sixth transistor, a driving transistor and a capacitor. A first terminal of the first transistor receives a reference voltage. A first terminal of the second transistor is coupled to a second terminal of the first transistor. A second terminal of the second transistor is coupled to a first node. A first terminal of the third transistor is coupled to the second terminal of the first transistor. A first terminal of the fourth transistor receives a data signal. The second terminal of the fourth transistor is coupled to a second node. A first terminal of the fifth transistor receives a system high voltage. A second terminal of the fifth transistor is coupled to the second node. A control terminal of the driving transistor is coupled to the first node. A first terminal of the driving transistor is coupled to the second node. A second terminal of the driving transistor is coupled to a second terminal of the third transistor. A first terminal of the sixth transistor is coupled to the second terminal of the driving transistor. A second terminal of the sixth transistor is coupled to a light emitting element. The capacitor is coupled between the first node and the first terminal of the fifth transistor.

An aspect of the present disclosure relates to a pixel circuit driving method, including: in a first frame, a writing circuit remains off; during a first period of the first frame, resetting an anode terminal of a light emitting element to a reset voltage level; and during a second period of the first frame, a light emission control circuit is turned on so that a driving transistor outputs a driving current to the light emitting element according to a system high voltage.

It is to be understood that both the foregoing general description and the following detailed description are by examples, and are intended to provide further explanation of the invention as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

The embodiments are described in detail below with reference to the appended drawings to better understand the aspects of the present application. However, the provided embodiments are not intended to limit the scope of the disclosure, and the description of the structural operation is not intended to limit the order in which they are performed. Any device that has been recombined by components and produces an equivalent function is within the scope covered by the disclosure.

The terms used in the entire specification and the scope of the patent application, unless otherwise specified, generally have the ordinary meaning of each term used in the field, the content disclosed herein, and the particular content.

The terms "first", "second", "third", etc. used in this specification do not specifically refer to order or sequence, nor are they intended to limit this disclosure. They are only used to distinguish the components or operations described in the same technical terms.

The terms "coupled" or "connected" as used herein may mean that two or more elements are directly in physical or electrical contact, or are indirectly in physical or electrical contact with each other. It can also mean that two or more elements interact with each other.

The lower case English index of component numbers and signal numbers (such as: 1 to k) used in the specification and drawings of this case is just for the convenience of referring to individual components and signals, and it is not intended to limit the number of the foregoing components and signals to a specific number. In the specification and drawings, if an element number or signal number is used and n is used as an index of the element number or signal number, it refers to any unspecified element or signal in the element group or signal group to which it belongs. For example, the object referred to by the component number S1[1] is the first control signal S1[1], and the object referred to by the component number S1[*n*] is the unspecified any first control signal among the first control signals S1[1] to S1[*k*].

Figure 1:
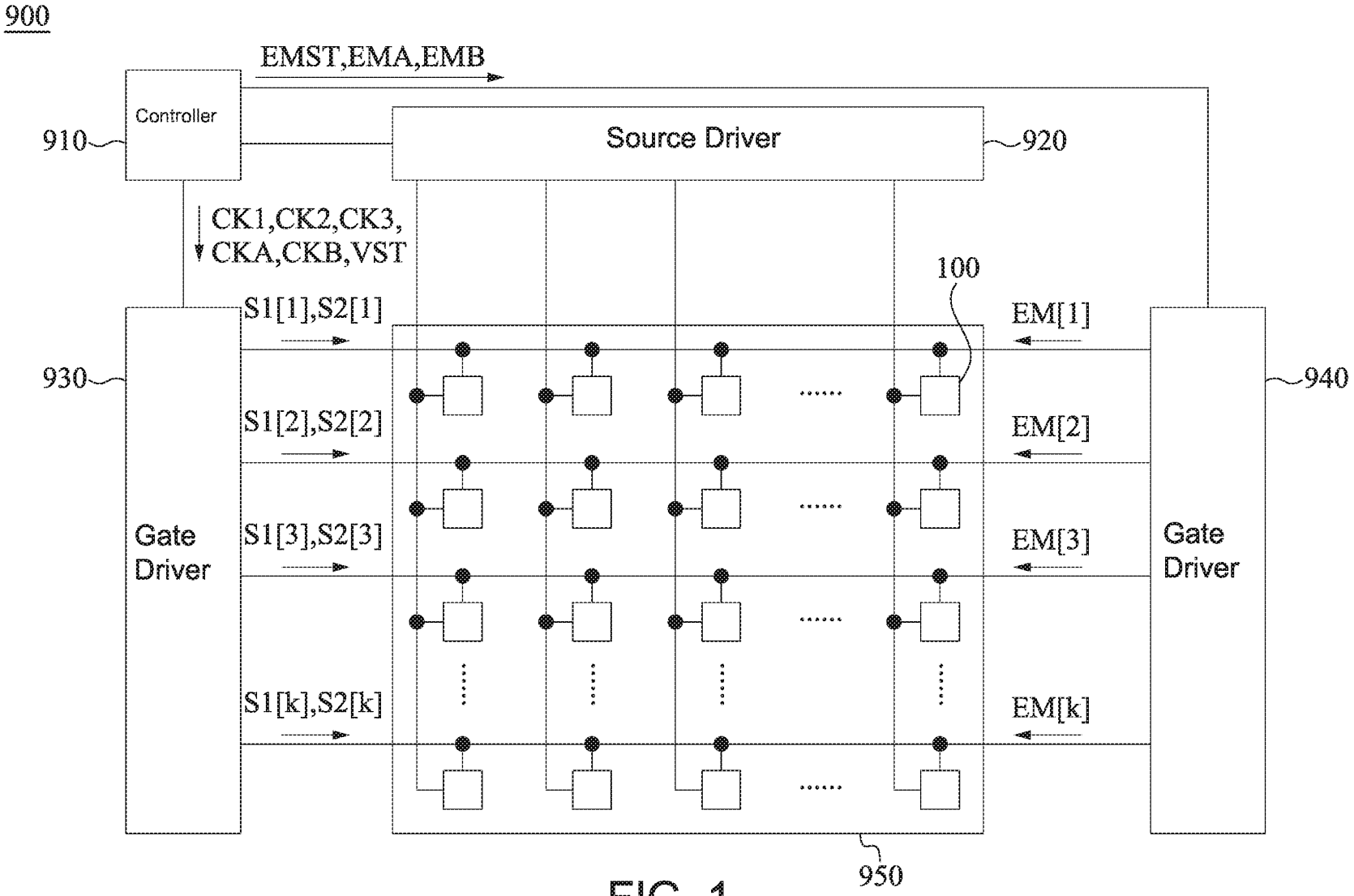
FIG. 1 is a schematic diagram of a display device according to some embodiments of the present disclosure.

Reference is made to FIG. 1. FIG. 1 is a schematic diagram of a display device 900 according to some embodiments of the present disclosure. As shown in FIG. 1, the display device 900 includes a controller 910, a source driver 920, gate drivers 930 and 940, and a display panel 950. The display panel 950 includes a plurality of pixel circuits 100 arranged in an array. Structurally, the controller 910 is coupled to the source driver 920 and the gate drivers 930 and 940. The source driver 920 is connected to the pixel circuits 100 in the display panel 950 through data lines. The gate drivers 930 and 940 are disposed on both sides of the display panel 950, and are connected to the pixel circuits 100 in the display panel 950 through scan lines.

In operation, the controller 910 is used to output a start signal VST, clock signals CK1, CK2, CK3, CKA and CKB to the gate driver 930, and is used to output a start signal EMST, clock signals EMA and EMB to the gate driver 940. The gate driver 930 is configured to generate the first control signals S1[1]-S1[*k*] and the second control signals S2[1]-S2[*k*] according to the start signal VST, the clock signals CK1, CK2, CK3, CKA and CKB, and is configured to output the first control signals S1[1]-S1[*k*] and the second control signals S2[1]-S2[*k*] to the corresponding pixel circuit 100. The gate driver 940 is configured to generate light emission control signals EM[1]-EM[k] according to the start signal EMST and the clock signals EMA and EMB, and is configured to output the light emission control signals EM[1]-EM[k] to the corresponding pixel circuits 100.

It is worth noting that although in the embodiment of FIG. 1, the display device 900 includes gate drivers 930 and 940 disposed on both sides of the display panel 950 to output different control signals (such as the first control signals S1[1]-S1[*k*], the second control signals S2[1]-S2[*k*] and the light emission control signals EM[1]-EM[k]), but they are only examples for convenience of explanation, not for limitation. In some other embodiments, the display device 900 may only include a single gate driver provided on either side of the display panel 950 to output all control signals.

Figure 2:
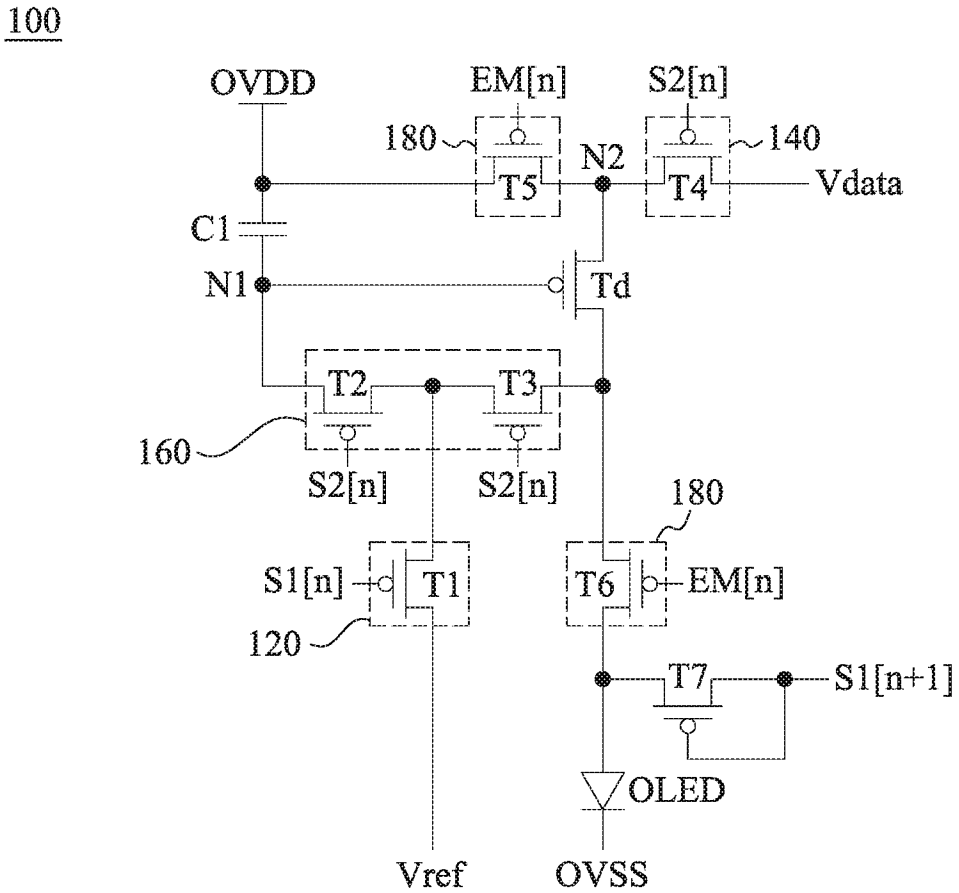
FIG. 2 is a schematic diagram of a pixel circuit according to some embodiments of the present disclosure.

Reference is made to FIG. 2. FIG. 2 is a schematic diagram of a pixel circuit 100 according to some embodiments of the present disclosure. In some embodiments, the pixel circuit 100 can be used for an active matrix liquid crystal display (AMLCD), an active matrix organic light emitting display (AMOLED), and an active matrix micro light emitting display (AMμLED), etc. The display device 900 may include a plurality of pixel circuits 100 as shown in FIG. 2 to form a complete display screen.

As shown in FIG. 2, the pixel circuit 100 includes a reset circuit 120, a writing circuit 140, a compensation circuit 160, a light emission control circuit 180, a capacitor C1, a driving transistor Td and a light emitting element OLED. The driving transistor Td includes a first terminal, a second terminal and a control terminal. Structurally, the reset circuit 120 is coupled to the compensation circuit 160. The compensation circuit 160 is coupled to the control terminal (i.e., node N1) of the driving transistor Td and the second terminal of the driving transistor Td. The writing circuit 140 is coupled to the first terminal (i.e., node N2) of the driving transistor Td. The second terminal of the driving transistor Td is coupled to the light emitting element OLED through the light emission control circuit 180.

Specifically, in some embodiments, the reset circuit 120 includes a transistor T1. The compensation circuit 160 includes transistors T2 and T3. The writing circuit 140 includes a transistor T4. The light emission control circuit 180 includes transistors T5 and T6. In some other embodiments, the pixel circuit 100 further includes a transistor T7.

The first terminal of the driving transistor Td is coupled to the node N2. The control terminal of the driving transistor Td is coupled to the node N1. The driving transistor Td is configured to selectively turn on or off according to the voltage level of the node N1. The first terminal of the capacitor C1 is configured to receive the system high voltage OVDD. The second terminal of the capacitor C1 is coupled to the control terminal (i.e., node N1) of the driving transistor Td.

The first terminal of the transistor T1 is configured to receive the reference voltage Vref. The second terminal of the transistor T1 is coupled to the first terminal of the transistor T2 and the first terminal of the transistor T3. The control terminal of the transistor T1 is configured to receive the first control signal S1[*n*] and selectively turn on or off according to the first control signal S1[*n*].

The second terminal of the transistor T2 is coupled to the control terminal (i.e., node N1) of the driving transistor Td. The second terminal of the transistor T3 is coupled to the second terminal of the driving transistor Td. The control terminal of the transistor T2 and the control terminal of the transistor T3 are configured to receive the second control signal S2[*n*] and selectively turn on or off according to the second control signal S2[*n*].

The first terminal of the transistor T4 is configured to receive the data signal Vdata. The second terminal of the transistor T4 is coupled to the first terminal of the driving transistor Td (i.e., the node N2). The control terminal of the transistor T4 is configured to receive the second control signal S2[*n*] and selectively turn on or off according to the second control signal S2[*n*].

The first terminal of the transistor T5 is configured to receive the system high voltage OVDD. The second terminal of the transistor T5 is coupled to the first terminal (i.e., node N2) of the driving transistor Td. The control terminal of the transistor T5 is configured to receive the light emission control signal EM[n] and selectively turn on or off according to the light emission control signal EM[n].

The first terminal of the transistor T6 is coupled to the second terminal of the driving transistor Td. The second terminal of the transistor T6 is coupled to the anode terminal of the light emitting element OLED. The control terminal of the transistor T6 is configured to receive the light emission control signal EM[n] and selectively turn on or off according to the light emission control signal EM[n].

The first terminal of the transistor T7 is coupled to the control terminal of the transistor T7. The second terminal of the transistor T7 is coupled to the anode terminal of the light emitting element OLED. The transistor T7 is configured to receive the first control signal S1[*n*+1] of the subsequent transmission stage and selectively turn on or off according to the first control signal S1[n+1] of the subsequent transmission stage. The cathode terminal of the light emitting element OLED is coupled to the system low voltage OVSS.

In this embodiment, as shown in FIG. 2, the transistors T1, T2, T3, T4, T5, T6 and T7 and the driving transistor Td are all P-type thin film transistors, but the present application is not limited thereto. In some other embodiments, those with ordinary knowledge in the art can also implement N-type thin film transistors. In addition, in some embodiments, the light emitting element OLED may be a light emitting diode, a micro light emitting diode, or the like.

Figure 3:
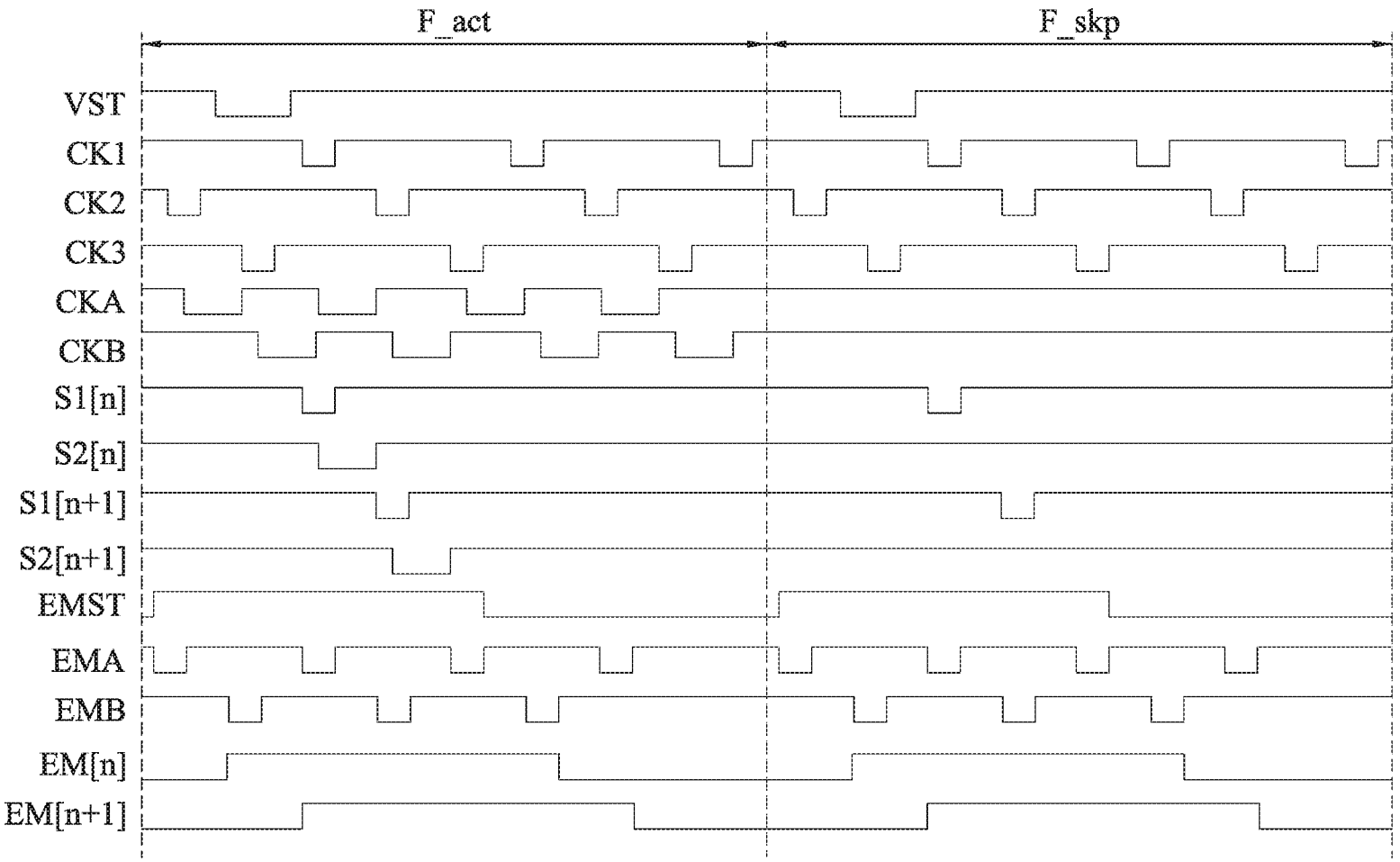
FIG. 3 is a signal timing diagram of a pixel circuit according to some embodiments of the present disclosure.

For the convenience of description, the specific operations of each element in the pixel circuit 100 will be described with the drawings in the following paragraphs. Please refer to FIG. 2 and FIG. 3 together. FIG. 3 is a signal timing diagram of a pixel circuit 100 according to some embodiments of the present disclosure. As shown in FIG. 3, both the period F_act and the period F_skp are the time of one frame. For the convenience of explanation, only the control signals and clock signals of two pixel circuits (current stage and subsequent transmission stage) are shown in a frame. Accordingly, those with ordinary knowledge in the art can infer the control signals of all pixel circuits (Stage 1 to Stage k). Where the signal in the period F_act is the signal when the frame is generally updated, and the signal in the period F_skp is the signal to maintain the previous frame. In other words, the new data signal Vdata is not written to the pixel circuit 100 in the period F_skp. However, in this embodiment, the anode terminal of the light emitting element OLED is still reset and illuminates in the period F_skp.

In some embodiments, in the normal mode, the signal of each frame of the display device 900 is as shown in the period F_act. In the power saving mode, the signal of each frame of the display device 900 is alternately shown in the period F_act and the period F_skp. For example, in the normal mode, the frame rate may be about 45 Hz. When the display device 900 displays a static image, a display content with a small change range or a slow change speed, the signal of the current frame of the display device 900 is shown in the period F_act, the signal of the next frame is shown in the period F_skp, and the signal of the frame after next is shown in the period F_act, and so on. For another example, the display device 900 takes the i frames as a cycle, the signal of the first frame in the cycle is shown by the period F_act, and the signals of the second to i frames are shown by the period F_skp, where i is any positive integer greater than 1. In this way, when i is 3, the first frame will be updated, and the second and third frames will not be updated, then the frame rate is about 45/3=15 Hz.

Specifically, as shown in FIG. 3, during the period F_act, the clock signals CK1, CK2, CK3, CKA, CKB, EMA and EMB are switched between the low level and the high level. The start signal VST and the control signals S1[n], S2[n], S1[n+1] and S2[n+1] turn from high level to low level in sequence. The start signal EMST and the light emission control signals EM[n] and EM[n+1] turn from the turn-off voltage level to the turn-on voltage level in sequence.

In other words, during the period F_act, the gate driver 930 is configured to generate the control signals S1[n], S2[n], S1[n+1], S2[n+1] according to the clock signals CK1, CK2, CK3, CKA, CKB and the start signal VST. The gate driver 940 is configured to generate light emission control signals EM[n] and EM[n+1] according to the clock signals EMA, EMB and the start signal EMST, so that the pixel circuit 100 resets, writes, compensates and emits light based on the control signals S1[n], S2[n], S1[n+1], S2[n+1].

Figure 4A:
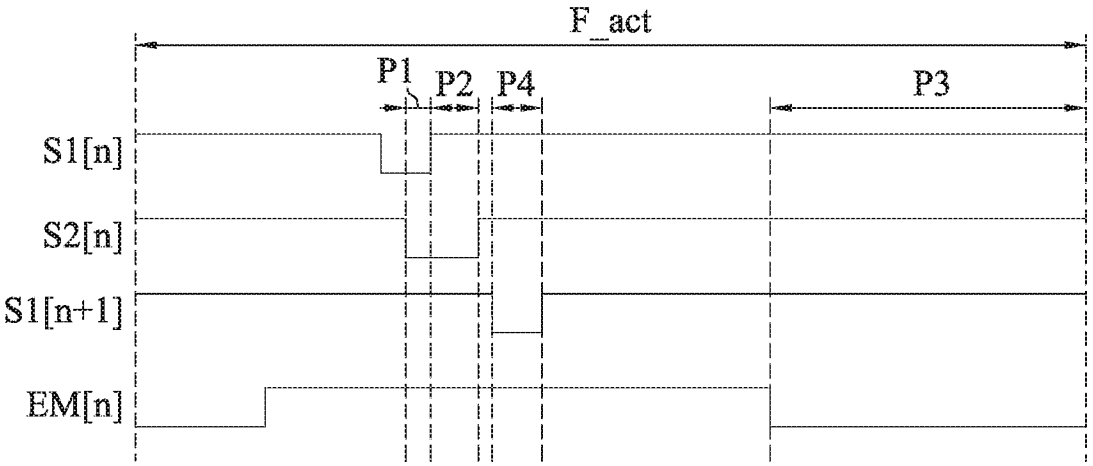
FIGS. 4A and 4B are enlarged signal timing diagrams of a pixel circuit according to other embodiments of the present disclosure.

Please refer to FIG. 4A for further details on the signals as the frame is updated during the period F_act. FIG. 4A is an enlarged signal timing diagram of a pixel circuit 100 during the period F_act according to other embodiments of the present disclosure. As shown in FIG. 4A, in some embodiments, the period F_act includes the period P1, the period P2 and the period P3. Specifically, the period P1 is a reset and write phase, the period P2 is a compensation phase, and the period P3 is a light-emitting phase. In some other embodiments, the period F_act further includes the period P4. Specifically, the period P4 is a phase in which the anode terminal of the light emitting element OLED is reset.

Figure 5:
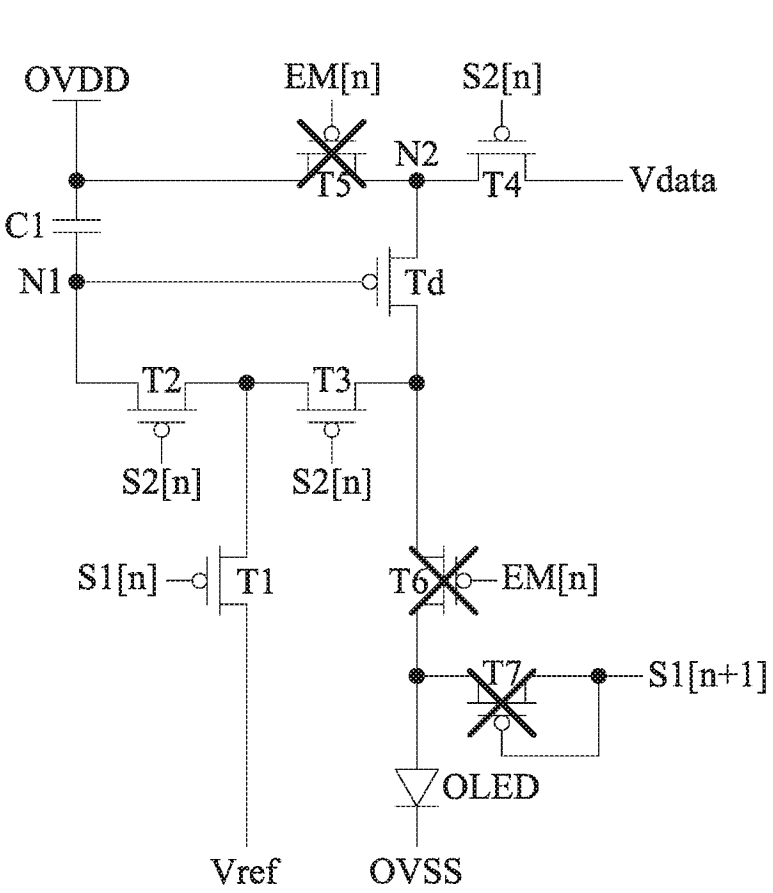
FIG. 5 is a schematic diagram illustrating the state of each transistor in the pixel circuit of FIG. 2 during the first period of the frame update according to some embodiments of the present disclosure.

Please refer to FIG. 4A and FIG. 5 together. FIG. 5 is a schematic diagram illustrating the state of each transistor in the pixel circuit 100 of FIG. 2 during the first period P1 (i.e., the reset and write phase) of the frame update (the period F_act) according to some embodiments of the present disclosure. As shown in FIG. 4A, in the period P1, the light emission control signal EM[n] is firstly turned to the turn-off voltage level, for example, for the P-type transistor, the high voltage level (i.e., the high level shown in FIG. 4A). Then, the first control signal S1[n] and the second control signal S2[n] are sequentially turned to the turn-on voltage level, for example, for the P-type transistor, the low voltage level (i.e., the low level shown in FIG. 4A).

As shown in FIG. 5, the transistors T5 and T6 are turned off according to the high-level light emission control signal EM[n], and then the transistor T1 is turned on according to the low-level first control signal S1[n] to provide a reference voltage Vref to the first terminals of transistors T2 and T3. Then, the transistors T2 and T3 are turned on according to the low-level second control signal S2[n] to provide the reference voltage Vref to the node N1. At the same time, the transistor T4 is turned on according to the low-level second control signal S2[n] to provide the data signal Vdata to the node N2.

Therefore, during the period P1, the control terminal (i.e., node N1) of the driving transistor Td is reset to the reference voltage Vref, and the first terminal (i.e., node N2) of the driving transistor Td receives the data signal Vdata. In addition, during the period P1, the first control signal S1[n+1] of the subsequent transmission stage maintains the turn-off voltage level (the high level as shown in FIG. 4A). Therefore, the transistor T7 remains turned off.

Figure 6:
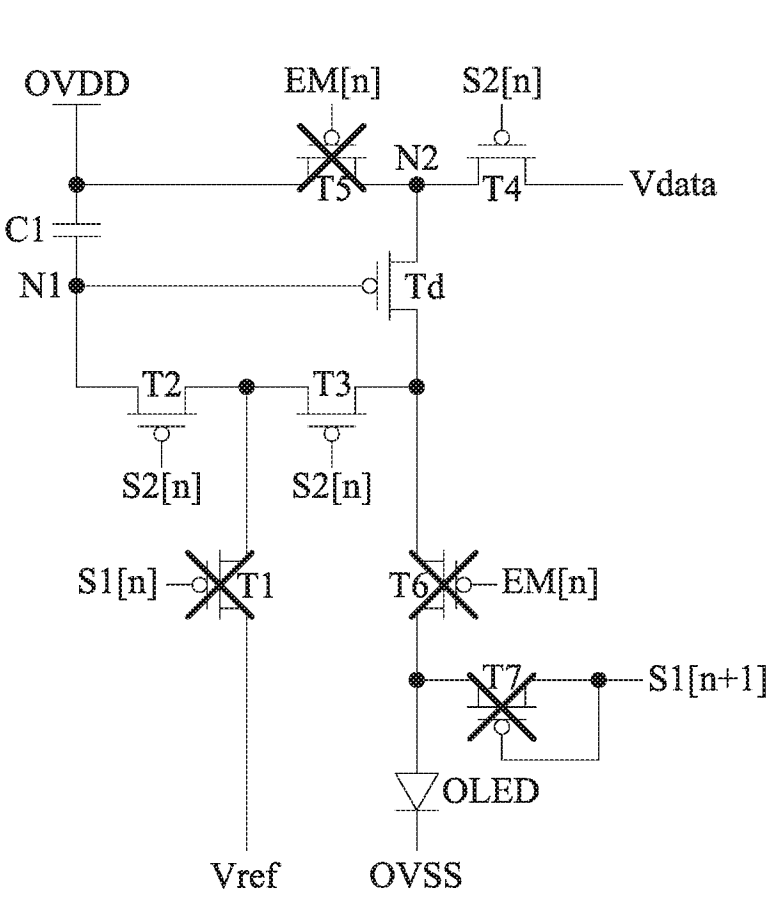
FIG. 6 is a schematic diagram illustrating the state of each transistor in the pixel circuit of FIG. 2 during the second period of the frame update according to some embodiments of the present disclosure.

Next, please refer to FIG. 4A and FIG. 6 together. FIG. 6 is a schematic diagram illustrating the state of each transistor in the pixel circuit 100 of FIG. 2 during the second period P2 (i.e., the compensation phase) of the frame update (the period F_act) according to some embodiments of the present disclosure. As shown in FIG. 4A, in the period P2, the first control signal S1[n] is turned to the turn-off voltage level (the high level shown in FIG. 4A). Since other signals remain unchanged, they will not be repeated here. As shown in FIG. 6, the transistor T1 is turned off according to the high-level first control signal S1[n], the transistors T2, T3 and T4 remain turned on, and the transistors T5, T6 and T7 remain turned off.

Therefore, during the period P2, the voltage difference between the first terminal and the control terminal of the driving transistor Td is the data signal Vdata minus the reference voltage Vref. This voltage difference is greater than the threshold voltage of the driving transistor Td, so that the driving transistor Td is turned on. After being turned on, the driving transistor Td charges its second terminal and its control terminal according to the data signal Vdata received by its first terminal, until the voltage difference between the first terminal and the control terminal of the driving transistor Td is reduced to the threshold voltage of the driving transistor Td. That is, during the period P2, the control terminal (i.e., node N1) of the driving transistor Td is compensated to the compensation voltage level, which is the data signal Vdata minus the threshold voltage of the driving transistor Td.

Figure 7:
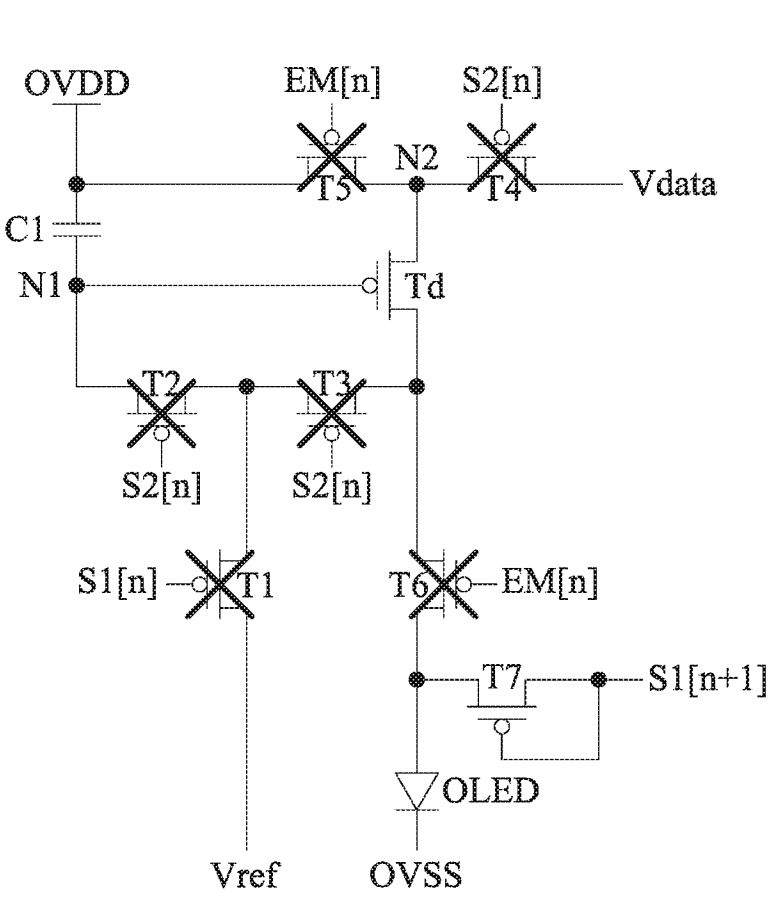
FIG. 7 is a schematic diagram illustrating the state of each transistor in the pixel circuit of FIG. 2 during the fourth period of the frame update according to some embodiments of the present disclosure.

Next, please refer to FIG. 4A and FIG. 7 together. FIG. 7 is a schematic diagram illustrating the state of each transistor in the pixel circuit 100 of FIG. 2 during the fourth period P4 (i.e., the phase of resetting the anode terminal of the light emitting element OLED) of the frame update (the period F_act) according to some embodiments of the present disclosure. As shown in FIG. 4A, at the end of the period P2, the second control signal S2[$n$] changes to the turn-off voltage level. In the period P4, the first control signal S1[$n$+1] of the subsequent transmission stage is turned to the turn-on voltage level (the low level shown in FIG. 4A). Since other signals remain unchanged, they will not be repeated here.

As shown in FIG. 7, the transistors T1, T2, T3, T4, T5 and T6 are turned off, and the transistor T7 is turned on according to the low-level first control signal S1[$n$+1], so that the anode terminal of the light emitting element OLED is reset to the reset voltage level (i.e., the low level). In this way, by the first control signal S1[$n$+1] of the subsequent transmission stage, it can be ensured that the light emitting element OLED has no residual charge before the light-emitting phase.

Figure 8:
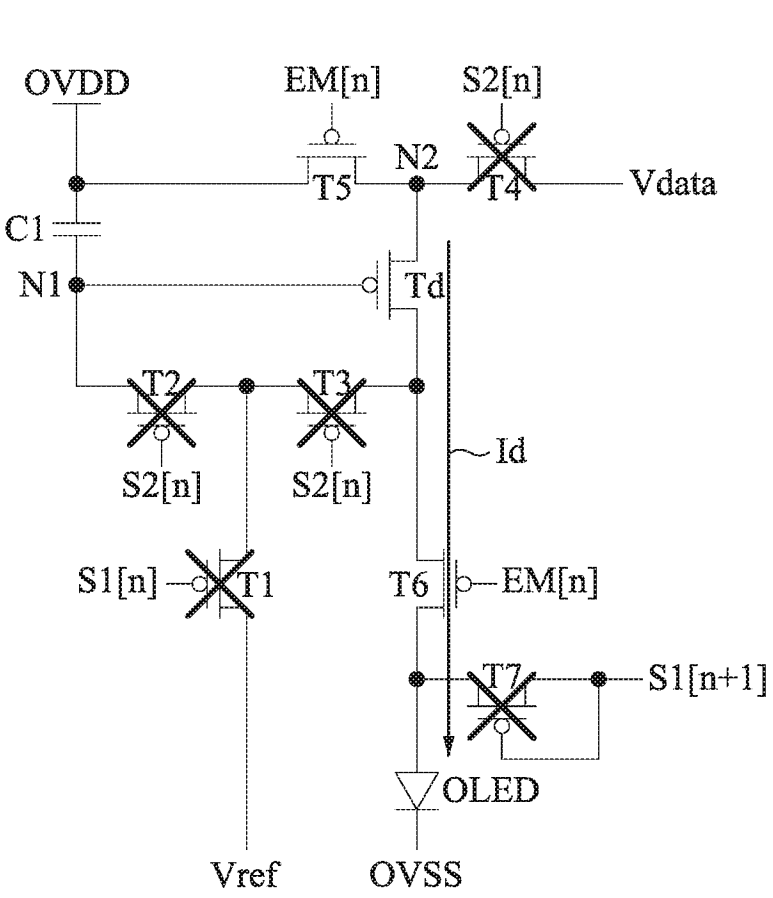
FIG. 8 is a schematic diagram illustrating the state of each transistor in the pixel circuit of FIG. 2 during the third period of the frame update according to some embodiments of the present disclosure.

Next, please refer to FIG. 4A and FIG. 8 together. FIG. 8 is a schematic diagram illustrating the state of each transistor in the pixel circuit 100 of FIG. 2 during the third period P3 (i.e., the light-emitting phase) of the frame update (the period F_act) according to some embodiments of the present disclosure. As shown in FIG. 4A, in the period P3, the light emission control signal EM[n] is turned to the turn-on voltage level (such as the low level shown in FIG. 4A), and the other signals remain unchanged, which will not be repeated here. As shown in FIG. 8, the transistors T1, T2, T3, T4 and T7 are turned off, and the transistors T5 and T6 are turned on according to the low-level light emission control signal EM[n] to provide the system high voltage OVDD to the first terminal of the driving transistor Td (i.e., node N1), so that the driving transistor Td outputs the driving current Id as shown in the following formula (1):

$$Id = \frac{1}{2}k[OVDD - (Vdata - Vth) - |Vth|]^2 = \frac{1}{2}k(OVDD - Vdata)^2 \quad (1)$$

where Vth is the threshold voltage of the driving transistor Td. k is the conduction parameter. In this way, by compensating the compensation voltage generated during the period P2, when the pixel circuit 100 is enabled to display, the value of the driving current Id will not be affected by the characteristics of the driving transistor Td (such as different threshold voltages), and thus a relatively stable driving current Id can be provided.

Please refer back to FIG. 3. During the period F_skp, similar to the period F_act, the clock signals CK1, CK2, CK3, EMA and EMB are switched between the low level and the high level. The start signal VST and the control signals S1[$n$], S1[$n$+1] turn from high level to low level in sequence. The start signal EMST and the light emission control signals EM[n] and EM[n+1] turn from the turn-off voltage level to the turn-on voltage level in sequence. However, during the period F_skp, the clock signals CKA, CKB, control signals S2[$n$], S2[$n$+1] have been maintained at a high level.

In other words, during the period F_skp, the gate driver 930 is configured to generate the control signals S1[$n$], S1[$n$+1] based on the clock signals CK1, CK2, CK3 and the start signal VST, and the gate driver 940 is configured to generate the light emission control signals EM[n], EM[n+1] according to the clock signals EMA, EMB and the start signal EMST, so that the pixel circuit 100 performs resetting of the anode terminal of the light emitting element OLED according to the control signal S1[$n$+1] and illuminates, but does not write the data signal Vdata. In addition, during the period F_skp, although the reference voltage Vref is still continuously provided, since the control signal S2[$n$] does not operate during this period, the voltage of the node N1 will not be reset.

Figure 4B:
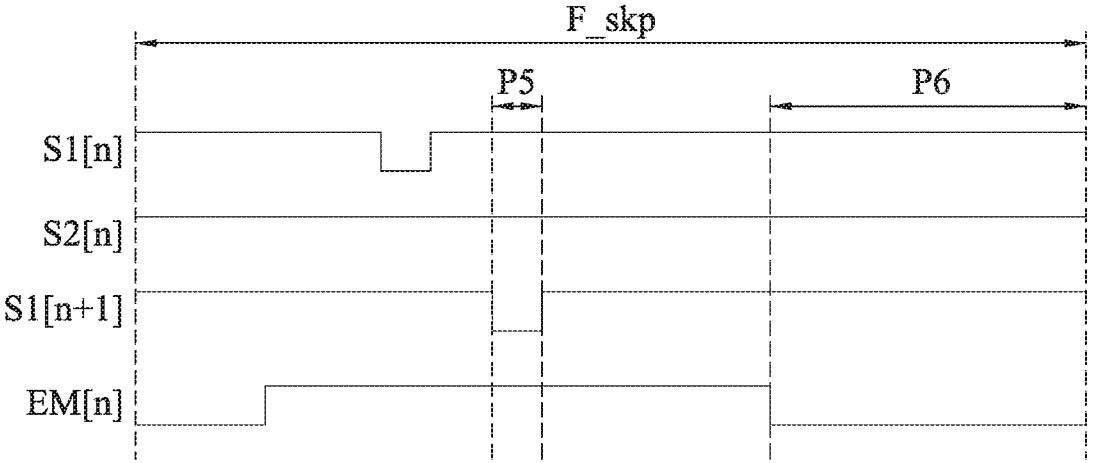

For further details on the signal maintaining the previous frame during the period F_skp, please refer to FIG. 4B. FIG. 4B is an enlarged signal timing diagram of a pixel circuit 100 during the period F_skp according to other embodiments of the present disclosure. As shown in FIG. 4B, in some embodiments, the period F_skp includes a period P5 and a period P6. Specifically, the period P5 is a phase in which the anode terminal of the light emitting element OLED is reset. The period P6 is a light-emitting phase.

As shown in FIG. 4B, in the period P5, similar to the period P4 in the period F_act, the first control signal S1[$n$+1] of the subsequent transmission stage is switched to the turn-on voltage level, and the other signals are the turn-off voltage level. Accordingly, the transistors T1, T2, T3, T4, T5 and T6 are turned off, and the transistor T7 is turned on according to the low-level first control signal S1[$n$+1], so that the anode terminal of the light emitting element OLED is reset to the reset voltage level (i.e., the low level).

In the period P6, similar to the period P3 in the period F_act, the light emission control signal EM[n] is turned on to the turn-on voltage level, and the other signals are all turn-off voltage level. Accordingly, the transistors T1, T2, T3, T4 and T7 are turned off, and the transistors T5 and T6 are turned on according to the low-level light emission control signal EM[n] to provide the system high voltage OVDD to the first terminal of the driving transistor Td (i.e., node N1), so that the driving transistor Td outputs the driving current Id.

In this way, even in the period F_skp where the signal maintaining the previous frame, since the start signal VST and the clock signals CK1, CK2 and CK3 continue to operate, through the first control signal S1[$n$+1], it is possible to reset the anode terminal of the light emitting element OLED before the light-emitting phase, to ensure that the light emitting element OLED does not have residual charge to affect the light-emitting brightness. Moreover, with the design of the pixel circuit 100 proposed in the present application, the voltage level of the control terminal (i.e., node N1) of the driving transistor Td is less likely to be affected, and during the period F_skp the voltage level can be maintained as that during the period P3 in the period F_act. Therefore, the light-emitting brightness during the period P6 in the period F_skp can be relatively close to that during the period P3 in the period F_act. In addition, since the reference voltage Vref is not provided to reset and the data signal Vdata is not written during the period F_skp, the power consumption can be saved.

It is worth noting that although in the embodiment of the present application, the transistor T7 is described by taking the first control signal S1[n+1] of the subsequent transmission stage as an example, the disclosure is not limited to this, and a person skilled in the art can adjust the design according to actual needs.

Figure 9A:
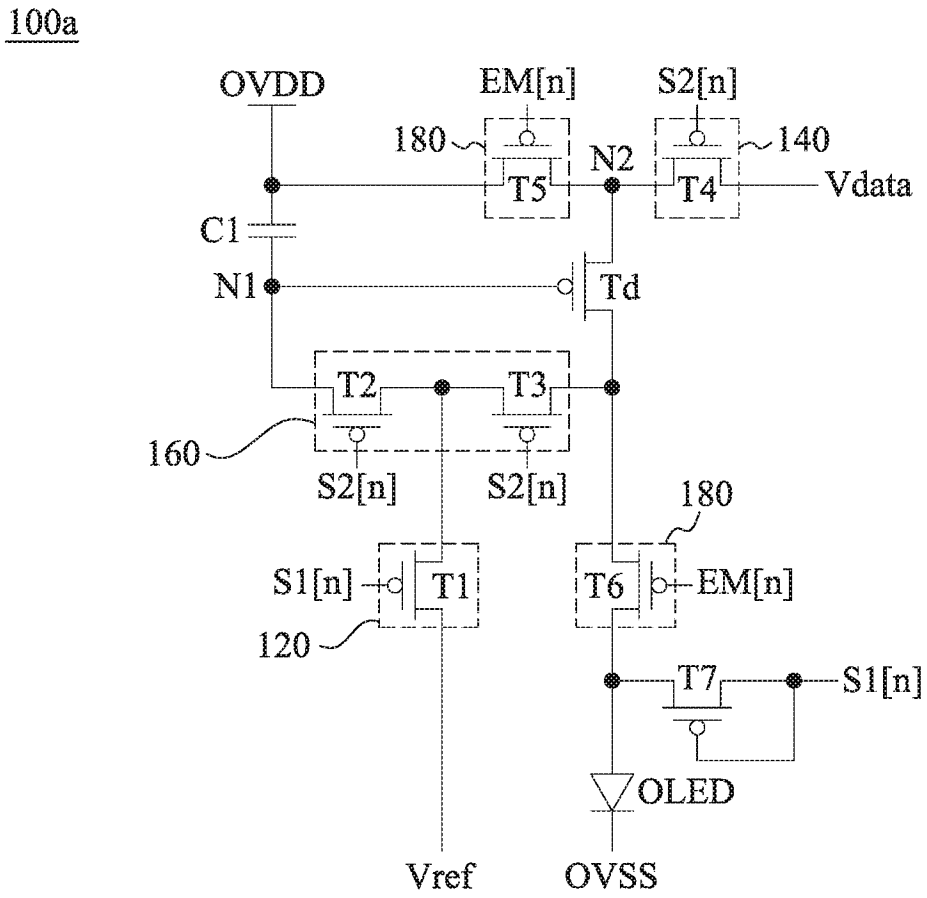
FIG. 9A is a schematic diagram illustrating another pixel circuit according to other embodiments of the present disclosure.
Figure 9B:
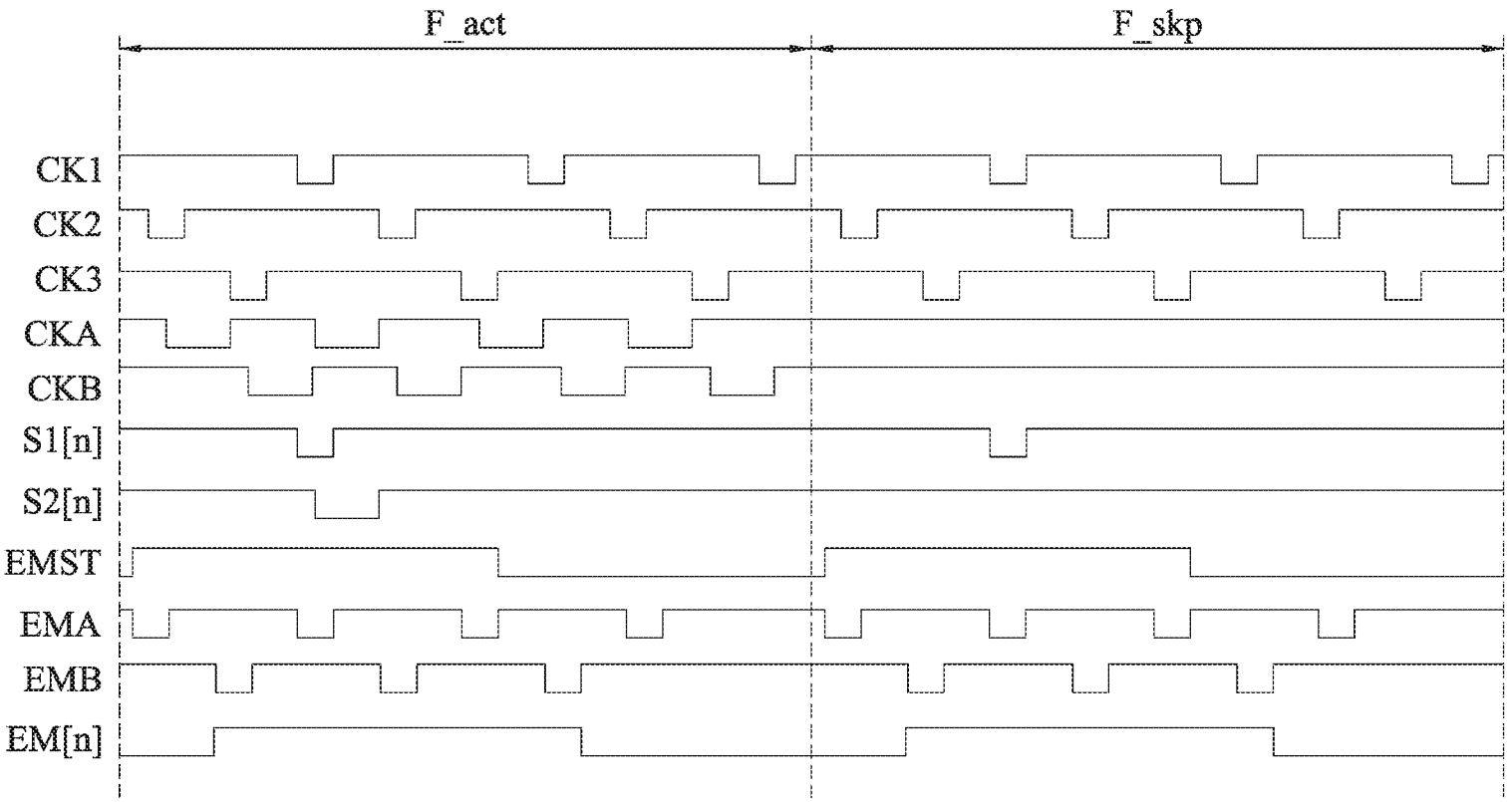
FIG. 9B is a signal timing diagram of a pixel circuit according to the embodiment of FIG. 9A.

Please refer to FIG. 9A and FIG. 9B. FIG. 9A is a schematic diagram illustrating another pixel circuit 100a according to other embodiments of the present disclosure. FIG. 9B is a signal timing diagram of a pixel circuit 100a according to the embodiment of FIG. 9A. As shown in FIG. 9A, in some embodiments, the transistor T7 may be configured to receive the first control signal S1[n] of the current stage. As shown in FIG. 9B, when the first control signal S1[n] changes from the high level to the low level, the transistors T1 and T7 of the pixel circuit 100a are turned on together. Then, the second control signal S2[n] also changes from the high level to the low level. In this way, the pixel circuit 100a resets the anode terminal of the light emitting element OLED to a low level while resetting the node N1 to the reference voltage Vref. Then, light-emitting display is performed.

Figure 10A:
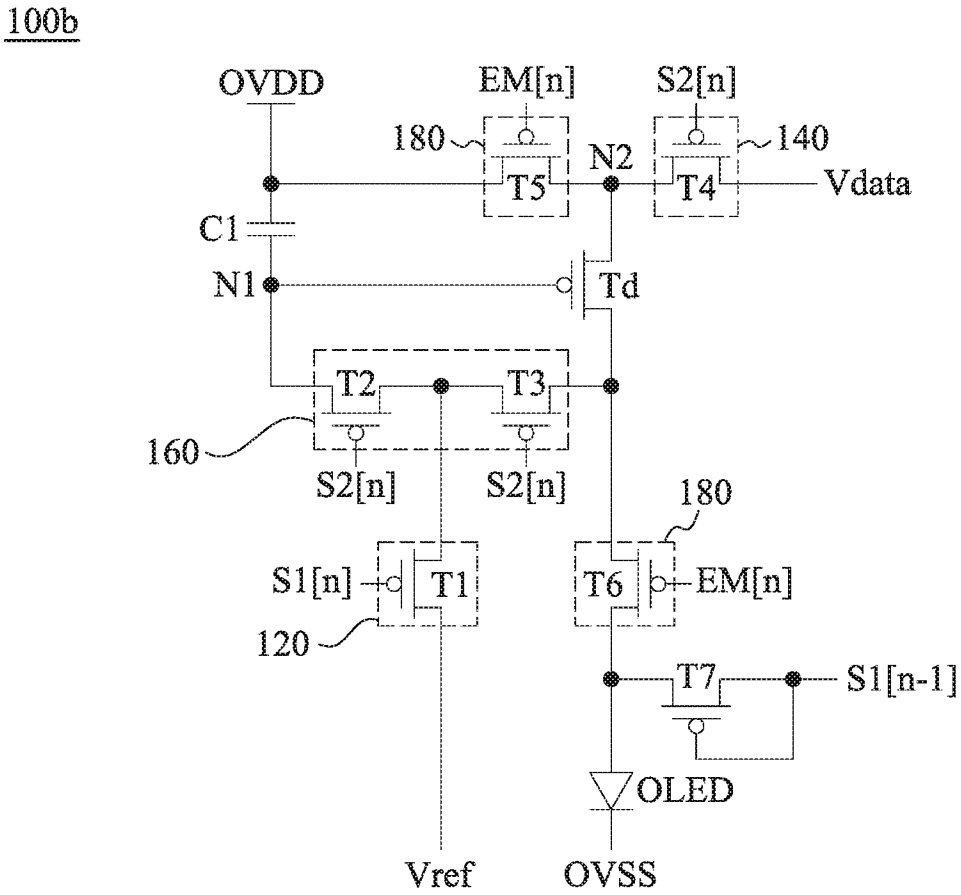
FIG. 10A is a schematic diagram illustrating another pixel circuit according to other embodiments of the present disclosure.
Figure 10B:
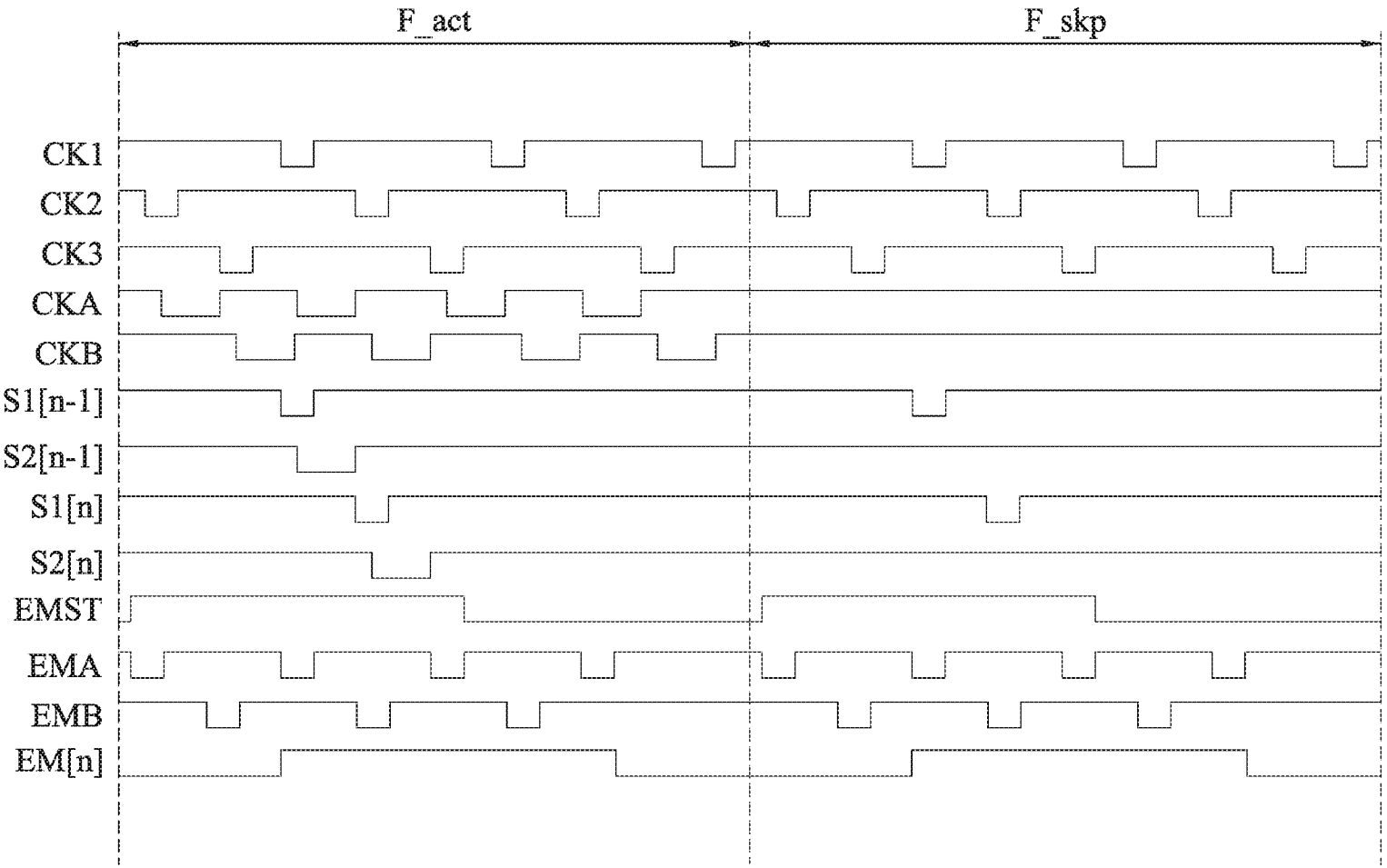
FIG. 10B is a signal timing diagram of a pixel circuit according to the embodiment of FIG. 10A.

Please refer to FIG. 10A and FIG. 10B. FIG. 10A is a schematic diagram illustrating another pixel circuit 100b according to other embodiments of the present disclosure. FIG. 10B is a signal timing diagram of a pixel circuit 100b according to the embodiment of FIG. 10A. As shown in FIG. 10A, in some other embodiments, the transistor T7 may be configured to receive the first control signal S1[n-1] of the previous stage. As shown in FIG. 10B, when the first control signal S1[n−1] changes from the high level to the low level, the transistor T7 of the pixel circuit 100b is turned on, thus resetting the anode terminal of the light emitting element OLED to the low Level. Then, the first control signal S1[n] and the second control signal S2[n] are sequentially switched from the high level to the low level, the transistors T1 and T2 of the pixel circuit 100b are turned on, and then the node N1 is reset to the reference voltage Vref. Finally, light-emitting display is performed.

Figure 11:
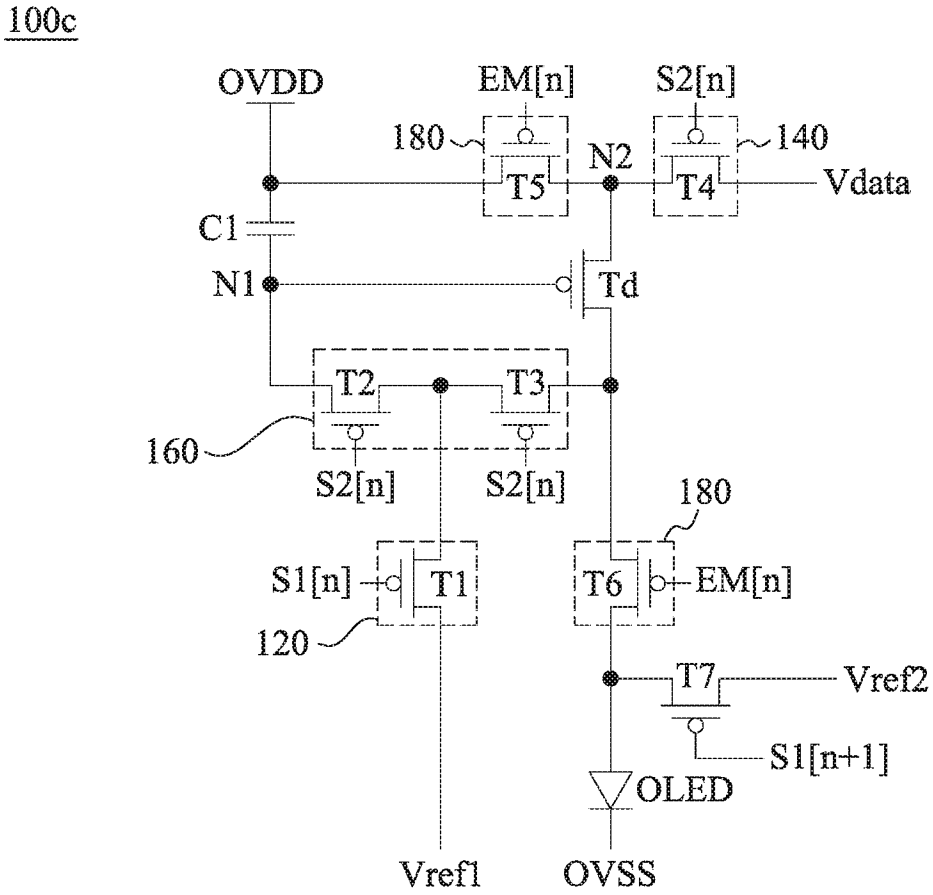
FIG. 11 is a schematic diagram of another pixel circuit according to other embodiments of the present disclosure.

Please refer to FIG. 11. FIG. 10A is a schematic diagram illustrating another pixel circuit 100c according to other embodiments of the present disclosure. As shown in FIG. 11, in some other embodiments, the first terminal of the transistor T1 is configured to receive the reference voltage Vref1. The first terminal of the transistor T7 is configured to receive the reference voltage Vref2. The control terminal of the transistor T7 is configured to receive the first control signal S1[n+1] and selectively turn on or off according to the first control signal S1[n+1]. The reference voltages Vref1, Vref2 and the above-mentioned reference voltage Vref may be the same, not completely the same, or completely different voltage levels. In addition, although in the embodiment shown in FIG. 11, the control terminal of the transistor T7 is to receive the first control signal S1[n+1] of the subsequent transmission stage, the disclosure is not limited thereto. Similar to FIGS. 9A-10B and related descriptions, in some other embodiments, the control terminal of the transistor T7 can be configured to receive the first control signal S1[n] of the current stage, or to receive the first control signal S1[n-1] of the previous stage.

Although the disclosed method is shown and described herein as a series of steps or events, it should be understood that the order of the steps or events shown should not be interpreted as limiting. For example, some steps may occur in a different order and/or simultaneously with other steps or events than those shown and/or described herein. In addition, not all of the steps shown here are necessary to implement one or more aspects or embodiments described herein. In addition, one or more steps herein may also be performed in one or more separate steps and/or stages.

In summary, in this case, by applying the above embodiments, in the period F_skp where the signal maintaining the previous frame, the new data signal Vdata is not written to the pixel circuit 100, but the pixel circuit 100 is still reset and displays light. By designing the pixel circuit 100 and resetting the anode terminal of the light emitting element OLED, the light emitting element OLED will not have residual charge to affect the light-emitting brightness, and the voltage level of the control terminal of the driving transistor Td can be maintained closer to that during the period F_act where the frame is updated. In this way, when the frame rate is reduced, power consumption can be saved and the brightness of the light can be stabilized to avoid flickering.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the invention. In view of the foregoing, it is intended that the present invention cover modifications and variations of this invention provided they fall within the scope of the following claims.

What is claimed is:

1. A pixel circuit, comprising:

a first transistor, wherein a first terminal of the first transistor receives a first reference voltage;

a second transistor, wherein a first terminal of the second transistor is coupled to a second terminal of the first transistor, and a second terminal of the second transistor is coupled to a first node;

a third transistor, wherein a first terminal of the third transistor is coupled to the second terminal of the first transistor;

a fourth transistor, wherein a first terminal of the fourth transistor receives a data signal, and a second terminal of the fourth transistor is coupled to a second node;

a fifth transistor, wherein a first terminal of the fifth transistor receives a system high voltage, and a second terminal of the fifth transistor is coupled to the second node;

a driving transistor, wherein a control terminal of the driving transistor is coupled to the first node, a first terminal of the driving transistor is coupled to the second node, and a second terminal of the driving transistor is coupled to a second terminal of the third transistor;

a sixth transistor, wherein a first terminal of the sixth transistor is coupled to the second terminal of the driving transistor, and a second terminal of the sixth transistor is coupled to a light emitting element;

a capacitor coupled between the first node and the first terminal of the fifth transistor; and a seventh transistor, wherein a first terminal of the seventh transistor and a control terminal of the seventh transistor are coupled to each other, and a second terminal of the seventh transistor is coupled to an anode terminal of the light emitting element, wherein during a first period of a first frame, a first node is reset to a first reference voltage while a second node remains at a voltage level of the data signal, wherein the first transistor is configured to selectively turn on according to a first control signal, the second transistor, the third transistor and the fourth transistor are configured to selectively turn on according to a second control signal, the seventh transistor is configured to selectively turn on according to a third control signal, and the fifth transistor and the sixth transistor are configured to selectively turn on according to a light emission control signal, wherein during the first period of the first frame, the first control signal and the second control signal are switched to a turn-on voltage level, so that the first transistor, the second transistor, the third transistor and the fourth transistor are turned on to provide the first reference voltage to the first node and provide the data signal to the second node, wherein during a second period of the first frame, the first control signal is switched to a turn-off voltage level, the second control signal is maintained at the turn-on voltage level, so that the second transistor, the third transistor and the fourth transistor are turned on to provide a compensation voltage to the first node, wherein during a third period of the first frame, the light emission control signal is switched to the turned-on voltage level, so that the fifth transistor and the sixth transistor are turned on to output a driving current to the light emitting element.

2. The pixel circuit of claim 1, wherein in a second frame, the second control signal is maintained at the turn-off voltage level, during a first period of the second frame, the third control signal is switched to the turn-on voltage level to turn on the seventh transistor, during a second period of the second frame, the light emission control signal is switched to the turn-on voltage level so that the light emitting element receives the driving current to emit light.

3. A pixel circuit driving method, comprising:

in a first frame, a writing circuit performs writing, and a light emitting element emits light;

in a second frame, the writing circuit remains off;

during a first period of the second frame, resetting an anode terminal of the light emitting element to a reset voltage level; and during a second period of the second frame, a light emission control circuit is turned on so that a driving transistor outputs a driving current to the light emitting element according to a system high voltage, wherein during a first period of the first frame, a control terminal of the driving transistor is reset to a first reference voltage while a first terminal of the driving transistor remains at a voltage level of a data signal, wherein during the first period of the first frame, a first transistor is turned on according to a first control signal, and a second transistor, a third transistor and a fourth transistor are turned on according to a second control signal, to reset the control terminal of the driving transistor to the first reference voltage, and provide the data signal to the first terminal of the driving transistor, wherein during a second period of the first frame, the first transistor is turned off according to the first control signal, and the second transistor, the third transistor and the fourth transistor are turned on according to the second control signal, to provide a compensation voltage to the control terminal of the driving transistor, wherein during a third period of the first frame, a fifth transistor and a sixth transistor are turned on according to a light emission control signal so that the driving transistor outputs the driving current to the light emitting element according to the system high voltage and the compensation voltage.

4. The pixel circuit driving method of claim 3, further comprising:

during a fourth period of the first frame, a seventh transistor is turned on according to a third control signal to reset the anode terminal of the light emitting element to the reset voltage level.

5. The pixel circuit driving method of claim 4, further comprising:

a gate driver generates the first control signal and the third control signal according to a first group of clock signals, and generates the second control signal according to a second group of clock signals, wherein in the second frame, the first group of clock signals is switched between a high level and a low level, and the second group of clock signals is maintained at the high level.

* * * * *